US009769883B2

(12) United States Patent
Hashimoto et al.

(10) Patent No.: US 9,769,883 B2
(45) Date of Patent: Sep. 19, 2017

(54) INDUCTION HEATING COOKER

(75) Inventors: Takuya Hashimoto, Hyogo (JP); Kenji Watanabe, Nara (JP); Shintaro Noguchi, Hyogo (JP); Taizo Ogata, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 580 days.

(21) Appl. No.: 13/256,154

(22) PCT Filed: Mar. 11, 2010

(86) PCT No.: PCT/JP2010/001730

§ 371 (c)(1),
(2), (4) Date: Sep. 12, 2011

(87) PCT Pub. No.: WO2010/106765

PCT Pub. Date: Sep. 23, 2010

(65) Prior Publication Data

US 2012/0000904 A1 Jan. 5, 2012

(30) Foreign Application Priority Data

Mar. 19, 2009 (JP) ..... 2009-067422
Jun. 16, 2009 (JP) ..... 2009-142885

(51) Int. Cl.
*H05B 6/12* (2006.01)
*H05B 6/06* (2006.01)

(52) U.S. Cl.
CPC ..... *H05B 6/062* (2013.01); *H05B 6/1209* (2013.01); *H05B 2213/04* (2013.01); *H05B 2213/07* (2013.01)

(58) Field of Classification Search
CPC ..... H05B 6/12; H05B 6/1209; H05B 6/1236; H05B 6/1245
(Continued)

(56) References Cited

U.S. PATENT DOCUMENTS 6,140,617 A 10/2000 Berkcan et al.
6,630,650 B2 * 10/2003 Bassill ..... H05B 6/062 219/626
(Continued)

FOREIGN PATENT DOCUMENTS

CA 2678840 2/2009
CN 1701639 A 11/2005
(Continued)

OTHER PUBLICATIONS

Translation of JP 03-184295A to Fukishima dated Dec. 14, 1989.*
(Continued)

*Primary Examiner* — Michael Laflame, Jr.
(74) *Attorney, Agent, or Firm* — Brinks Gilson & Lione

(57) ABSTRACT

There is provided a placement position determining part that calculates a rising gradient of an output value of the infrared sensor every after passage of a first predetermined time and performs a placement position determining operation of determining that a placement position of a cooking vessel is improper when the rising gradient is smaller than a first threshold value, and the placement position determining part performs the placement position determining operation after a lapse of a second predetermined time from the start of heating, thereby accurately determining that the cooking vessel is improperly placed on a top plate and preventing overheating of the cooking vessel.

17 Claims, 8 Drawing Sheets

(58) Field of Classification Search
USPC .... 219/446.1, 445.1, 448.1, 460.1, 620–627, 219/667, 711, 494, 518; 99/325, 451; 374/142, 149
See application file for complete search history.

(56) References Cited

U.S. PATENT DOCUMENTS

| | | | | |
|---|---|---|---|---|
| 7,102,109 | B2 * | 9/2006 | Niiyama et al. | 219/627 |
| 2007/0080158 | A1 * | 4/2007 | Takimoto | 219/627 |
| 2009/0314769 | A1 | 12/2009 | Bonnel et al. | |
| 2010/0051608 | A1 | 3/2010 | Tominaga et al. | |
| 2010/0065551 | A1 | 3/2010 | Tominaga et al. | |

FOREIGN PATENT DOCUMENTS

| | | | |
|---|---|---|---|
| DE | 4341485 | A1 | 6/1995 |
| EP | 1983804 | A1 * | 10/2008 |
| EP | 1983804 | A1 | 10/2008 |
| JP | 03-184295 | A | 8/1991 |
| JP | 2003-051377 | A | 2/2003 |
| JP | 2005-347000 | A | 12/2005 |
| JP | 2008-140678 | A | 6/2008 |
| JP | 2008-192581 | A | 8/2008 |
| WO | WO2007091440 | A1 * | 8/2007 |
| WO | WO 2008/000526 | A1 | 1/2008 |
| WO | WO 2008/003872 | A2 | 1/2008 |
| WO | WO 2008/120447 | A1 | 10/2008 |

OTHER PUBLICATIONS

Translation of JP 2003-051377A to Noguchi dated Feb. 21, 2003.*
International Search Report for International Application No. PCT/JP2010/001730, dated Jun. 15, 2010, 2 pages.
Extended Search Report for corresponding European application serial No. 10753262.4, dated Jul. 16, 2014, 6 pages.

* cited by examiner

INDUCTION HEATING COOKER

TECHNICAL FIELD

The present invention relates to an induction heating cooker used in kitchens in ordinary homes.

BACKGROUND ART

Conventionally, an induction heating cooker of this type includes a top plate for carrying a cooking vessel placed thereon, a heating coil for inductively heating the cooking vessel, and an infrared sensor for detecting an infrared ray emitted from a bottom surface of the cooking vessel, and accurately adjusts temperature of the cooking vessel generally by use of the infrared sensor. The induction heating cooker determines that the cooking vessel is improperly placed when a temperature-rise value after a lapse of a certain time from the start of heating is small, and stops outputting of an inverter circuit when the cooking vessel is improperly placed (refer to, for example, PTL 1).

Another induction heating cooker of this type further includes a heat-sensitive element in addition to the above-mentioned constituents, and adjusts temperature of the cooking vessel by switching between temperature adjustment based on the infrared sensor and temperature adjustment based on the heat-sensitive element depending on presence or absence of a failure of the infrared sensor (refer to, for example, PTL 2).

Still another induction heating cooker of this type increases a control temperature value of the heat-sensitive element when an increase in the output of the infrared sensor from the start of heating becomes a predetermined value or more, in addition to the above-mentioned constituents (refer to, for example, PTL 3).

However, in the induction heating cooker configured as in PTL 1, in the case where the amount of oil stored in the cooking vessel is large, since a temperature-rise gradient of the bottom surface of the cooking vessel with passage of time during heating is relatively small, it is difficult to distinguish the case where the cooking vessel is slightly displaced from a detecting window of the infrared sensor during heating from the case where the cooking vessel storing large amount of oil is placed at a proper position. For this reason, even if the cooking vessel is placed at the proper position, it may be disadvantageously determined that the cooking vessel is improperly placed.

In the induction heating cooker configured as in PTL 2, since temperature control based on the heat-sensitive element has a lower response than temperature control based on the infrared sensor, after switching to the temperature control based on the heat-sensitive element, there is a case where safety lowers or cooking performances are deteriorated.

In the induction heating cooker configured as in PTL 3, since the control temperature value of the heat-sensitive element is low when a heating operation is performed by using still hot cooking vessel already used for cooking a deep-fried dish, heating may be unnecessarily stopped or outputted. For this reason, this induction heating cooker has a problem of inconvenience.

PTL 1: Unexamined Japanese Patent Publication No. 3-184295

PTL 2: Unexamined Japanese Patent Publication No. 2008-192581

PTL 3: International Publication 2008/120447 booklet

SUMMARY OF THE INVENTION

To solve the above-mentioned conventional problems, even if the cooking vessel is slightly displaced from the detecting window of the infrared sensor during heating, the present invention provides an easy-to use induction heating cooker that can accurately determine the displacement and inform the displacement or prevent overheating.

The present invention includes a top plate for carrying a cooking vessel placed thereon, a heating coil provided under the top plate and for inductively heating the cooking vessel, an inverter circuit for supplying a high-frequency current to the heating coil, and an infrared sensor for detecting an infrared ray emitted from a bottom surface of the cooking vessel. The present invention further includes a control part for reducing an output of the inverter circuit or stopping a heating operation when a detected temperature of the infrared sensor is higher than a control temperature value of the infrared sensor, and a placement position determining part for calculating a rising gradient of detected temperature of the infrared sensor every after passage of a first predetermined time and performing a placement position determining operation for determining that a placement position of the cooking vessel is improper when the rising gradient is smaller than a first threshold value. The present invention has a configuration such that the placement position determining part performs the placement position determining operation after a lapse of a second predetermined time from the start of heating.

With such a configuration, when the cooking vessel is slightly displaced from the detecting window of the infrared sensor during heating, it is possible to accurately determine that the cooking vessel is placed at an improper position, and then, inform it, reduce a heating output, or stop a heating operation, which is convenient.

DETAILED DESCRIPTION OF THE PREFERRED EMBODIMENTS

An induction heating cooker according to the present invention will be described below based on exemplary embodiments with reference to the drawings. In the following exemplary embodiments, an output value of an infrared sensor is described by using an output voltage value corresponding to infrared emissions detected by the infrared sensor and defining an increase in the output voltage value of the infrared sensor as an increase in the output value of the infrared sensor, or by using a detected temperature value of the infrared sensor, which is obtained by converting the output value of the infrared sensor into corresponding temperature, and a rise value in the detected temperature value of the infrared sensor. The both values do not deviate from the present invention. In this manner, the present invention is not limited to the following exemplary embodiments.

First Exemplary Embodiment

Figure 1:
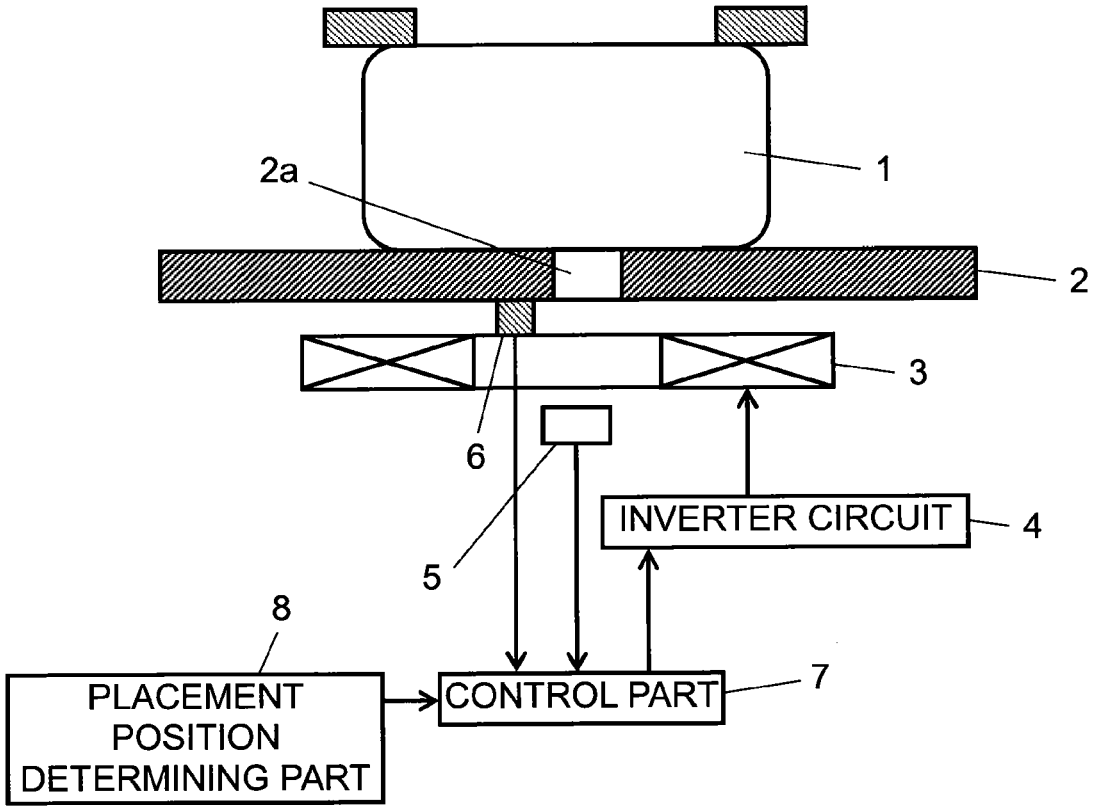
FIG. 1 is a block diagram showing an induction heating cooker according to a first exemplary embodiment of the present invention.
Figure 2:
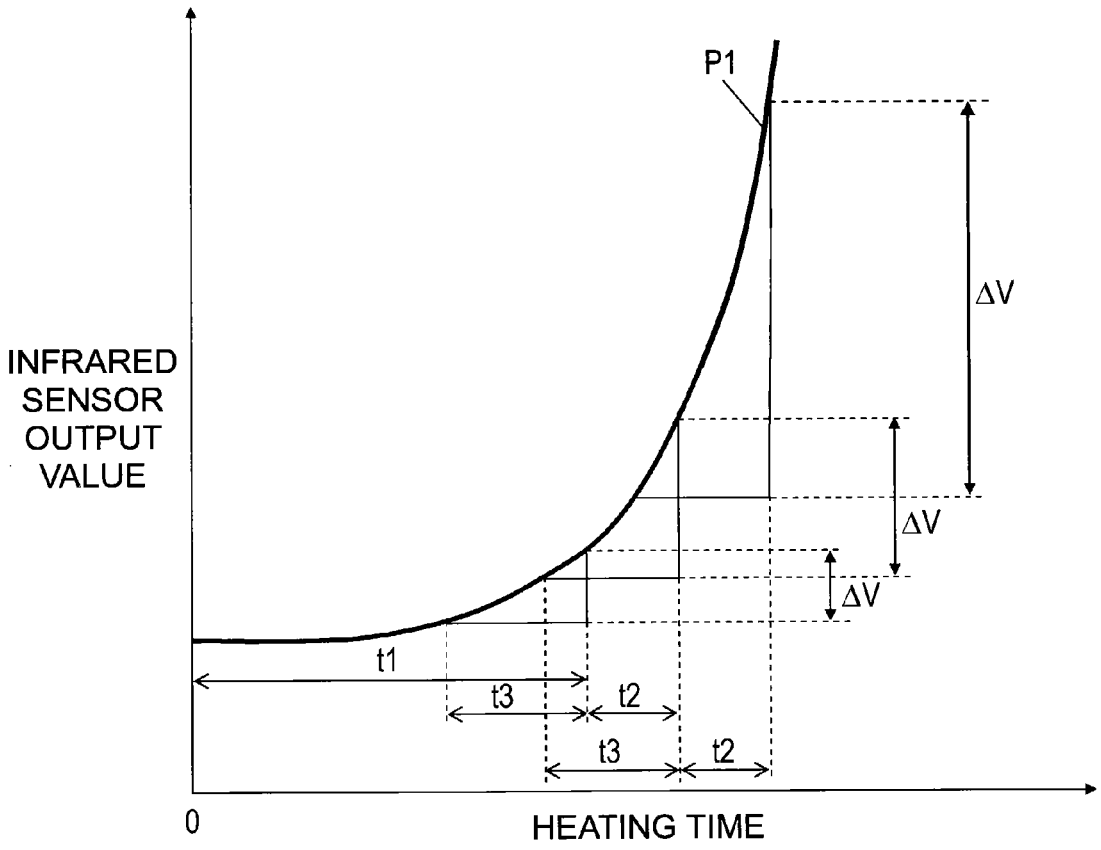
FIG. 2 is a diagram showing a relationship between an output value of an infrared sensor and heating time according to the first exemplary embodiment of the present invention.
Figure 3:
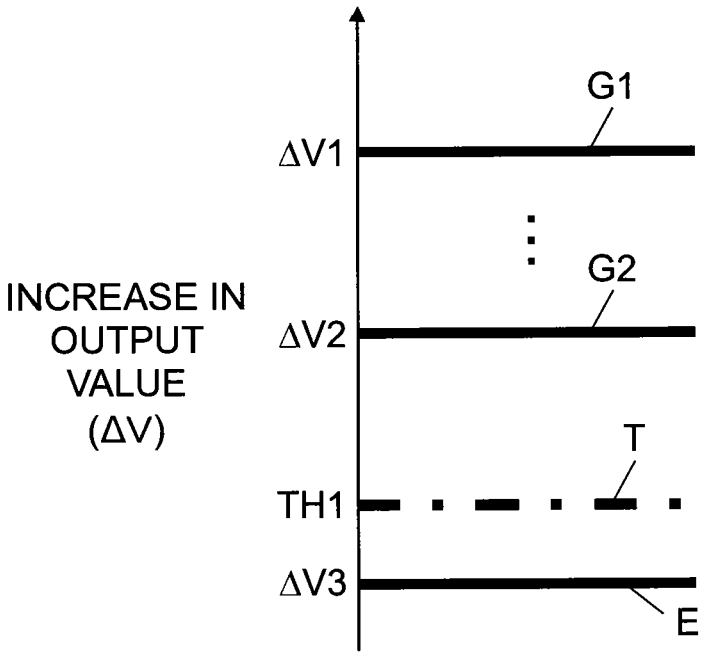
FIG. 3 is a diagram showing a relationship between an increase in the infrared sensor output value and threshold value S1 in the first exemplary embodiment of the present invention.

FIG. 1 is a block diagram showing an induction heating cooker according to a first exemplary embodiment of the present invention. FIG. 2 is a diagram showing an increase in an infrared sensor output value, which is calculated from an output value of an infrared sensor that detects infrared emissions corresponding to temperature of a bottom surface of a cooking vessel when the cooking vessel is heated at a predetermined heating output by the induction heating cooker according to this embodiment. FIG. 3 is a diagram showing setting of a threshold value in determining the propriety of a pan placement position based on the increase in the infrared sensor output value in this embodiment.

In FIG. 1, the induction heating cooker according to this embodiment includes top plate 2 for carrying cooking vessel 1 placed thereon, heating coil 3 provided under top plate 2 and for inductively heating cooking vessel 1, and inverter circuit 4 for supplying a high-frequency current to heating coil 3. The induction heating cooker further includes infrared sensor 5 for detecting an infrared ray emitted from the bottom surface of cooking vessel 1 via sensor window 2*a* formed on top plate 2. Sensor window 2*a* may be formed of another member differed from top plate 2 through which the infrared ray is transmitted. Alternatively, top plate 2 may be made of a ceramic material through which the infrared ray is transmitted, and a light-transmitting part of sensor window 2*a* may be made of the same material as that of top plate 2, and a back surface or a front surface of top plate 2 except for sensor window 2*a* may be subjected to light-resistant printing and an unprinted part may form sensor window 2*a*. Thus, infrared sensor 5 detects infrared emissions corresponding to temperature of the bottom surface of cooking vessel 1. The induction heating cooker further includes heat-sensitive element 6 such as a thermistor in contact with a lower surface of top plate 2 to detect temperature of cooking vessel 1 and placement position determining part 8 for determining a placement position of cooking vessel 1 on top plate 2. Since heat-sensitive element 6 receives heat of cooking vessel 1 through top plate 2 by heat conduction, heat-sensitive element 6 has a slower response speed than the infrared sensor 5. The induction heating cooker further includes control part 7 that reduces or stops outputting of inverter circuit 4 when the temperature detected by the heat-sensitive element 6 is higher than a control temperature value.

Basic operations of the induction heating cooker with such a configuration are as follows. When a power switch not shown is turned on, control part 7 controls the inverter circuit 4 to supply the high-frequency current to heating coil 3. Thereby, heating of cooking vessel 1 is started. Control part 7 controls the high-frequency current supplied to heating coil 3 based on the output of the infrared sensor 5, thereby controlling high-frequency power supplied to heating coil 3 to control heating amount. When cooking vessel 1 is heated and infrared sensor 5 receives the infrared ray that is emitted from cooking vessel 1 and transmits top plate 2, control part 7 calculates increase ΔV in the output value of infrared sensor 5 (hereinafter, referred to as merely increase ΔV in the output value).

According to calculated increase ΔV in the output value, control part 7 sets the control temperature value for heat-sensitive element 6 to any one of three control temperature values including control temperature value S1 (second control temperature value), control temperature value S2 (first control temperature value) that is higher than control temperature value S1, and control temperature value S3 (third control temperature value) that is higher than control temperature value S1. Control temperature value S2 may be equal to control temperature value S3. That is, control part 7 performs control to change the control temperature value for heat-sensitive element 6 to any of a plurality of values according to calculated increase ΔV in the output value. When the temperature detected by heat-sensitive element 6 becomes higher than the set control temperature value, control part 7 controls outputting of inverter circuit 4 or stops the heating operation. The induction heating cooker of this embodiment performs cooking in this manner as well as prevents abnormal overheating of the cooking vessel.

Operations and effects of the induction heating cooker according to this embodiment thus configured will be specifically described below.

In FIG. 2, line P1 shows a relationship between time passage and the output value of infrared sensor 5. In this embodiment, in cooking of deep-fried dish, at the start of heating (point of time 0), control part 7 sets the control temperature value for heat-sensitive element 6 to control temperature value S2 for predetermined time t1 (second predetermined time, for example, 110 seconds). After a lapse of predetermined time t1 from the start of heating, every after passage of predetermined time t2 (first predetermined time, for example, 1 second), increase ΔV in the output value of infrared sensor 5 for predetermined time t3 (third predetermined time, for example, 60 seconds) is calculated. Control part 7 compares increase ΔV in the output value of infrared sensor 5 with threshold value TH1 (first threshold value, for example, 0.6 V), sets the control temperature value for heat-sensitive element 6 to control temperature value S1 when increase ΔV in the output value is smaller than predetermined threshold value TH1, and sets the control temperature value for heat-sensitive element 6 to control temperature value S3 when increase ΔV in the output value is larger than threshold value TH1.

As described above, in this embodiment, since the control temperature value for heat-sensitive element 6 is set to control temperature value S2 that is higher than control temperature value S1 until predetermined time t1 has passed since the start of heating, that is, cooking vessel 1 is heated for a sufficient time and increase ΔV in the output value of infrared sensor 5, which is sufficiently larger than threshold value TH1, can be observed, an unstable heating state due to affects of cooking vessel 1 and top plate 2 that are hot in the heating initial stage can be avoided.

In other words, in this embodiment, after a lapse of predetermined time t1 from the start of heating, control part 7 compares increase ΔV in the output value of infrared sensor 5 with threshold value TH1, sets the control temperature value for heat-sensitive element 6 to control temperature value S3 that is higher than control temperature value S1 when increase ΔV in the output value is larger than threshold value TH1. Control temperature value S3 may be the same as control temperature value S2 or may be different from control temperature value S2. When increase ΔV in the output value is smaller than threshold value TH1, control part 7 determines that cooking vessel 1 is improperly placed and changes the control temperature value for heat-sensitive element 6 from control temperature value S2 to control temperature value S1 that is lower than control temperature value S2. That is, when cooking vessel 1 is normally placed on top plate 2, after a lapse of predetermined time t1, cooking vessel 1 is heated and increase ΔV in the output value becomes larger than threshold value TH1. Accordingly, even after a lapse of predetermined time t1, if increase ΔV in the output value is lower than threshold value TH1, control part 7 determines that cooking vessel 1 is improperly placed and changes the control temperature value for heat-sensitive element 6 from control temperature value S2 to control temperature value S1.

Incidentally, for example, in cooking of deep-fried dish, when unexpected cooking vessel 1 is used, temperature of cooking vessel 1 may abnormally increase. In this embodiment, as an example of unexpected cooking vessel 1, a description will be given of the case where variation in temperature of cooking vessels 1 having different emissivity is considered. FIG. 3 shows relationships among variations in increases ΔV in the output value due to material and position of cooking vessel 1 and threshold value TH1 in this embodiment. Line G1 shows increase ΔV1 in the output value (for example, 1.1 V corresponding to difference in detected temperature of 23° C.) in the case where cooking vessel 1 having a high emissivity (for example, a black-coated iron pan having a thickness of 2 mm, the amount of oil stored in the vessel is 800 g) is placed at a normal position on top plate 2 and heated. Line G2 shows increase ΔV2 in the output value (for example, 0.8V corresponding to difference in detected temperature of 20° C.) in the case where cooking vessel 1 having a low emissivity (for example, a magnetic stainless pan having a thickness of 2 mm, the amount of oil stored in the vessel is 800 g) is placed at a normal position on top plate 2 and heated. Line E shows increase ΔV3 in the output value in the case where infrared sensor 5 is broken, or cooking vessel 1 is not placed at the normal position on top plate 2 and is displaced from infrared sensor 5. Line T shows first threshold value TH1 (for example, 0.6V corresponding to difference in detected temperature of 12° C.).

In this embodiment, as represented by line T in FIG. 3, when infrared sensor 5 is broken or cooking vessel 1 is displaced from infrared sensor 5, threshold value TH1 is set to a value that is larger than increase ΔV3 in the output value detected by infrared sensor 5. Further, when cooking vessel 1 having a low emissivity is normally heated, threshold value TH1 is set to a value that is smaller than increase ΔV2 in the output value that can be detected by infrared sensor 5 after a lapse of predetermined time t1 from the start of heating. Control temperature value S1 is set to be temperature (for example, 100° C.) that is lower than temperature of the bottom surface of cooking vessel 1, which is safe under heating for a long time. Control temperature value S2 is set to be temperature (for example, 200° C. to 210° C.) that is higher than temperature of the bottom surface of cooking vessel 1, which can be generally detected for control by infrared sensor 5 in the case of heating cooking vessel 1 having a high emissivity and is equal to or lower than temperature that can prevent oil-catching fire and the like.

Accordingly, in this embodiment, during predetermined time t1 immediately after the start of heating, even if the temperature of top plate 6 is higher than the temperature of the bottom surface of cooking vessel 1, the control temperature value for heat-sensitive element 6 can be set to relatively high control temperature value S2, thereby eliminating the unstable operation immediately after heating. After a lapse of predetermined time t1 from the start of heating, control part 7 sets the control temperature value for heat-sensitive element 6 to control temperature value S3 that is larger than control temperature value S1 when increase ΔV in the output value of infrared sensor 5 is larger than threshold value TH1 to control temperature according to the output of infrared sensor 5. Like control temperature value S2, control temperature value S3 is set to be temperature (for example, 200° C. to 210° C.) that is higher than temperature of the bottom surface of cooking vessel 1, which can be generally detected for control by infrared sensor 5 in the case of heating cooking vessel 1 having a high emissivity and is equal to or lower than temperature that can prevent oil-catching fire and the like. Thereby, in the case where unexpected cooking vessel 1 (for example, the cooking vessel having a low emissivity) is placed on top plate 2, even if infrared sensor 5 cannot detect temperature, when the temperature of cooking vessel 1 exceeds control temperature value S2 or control temperature value S3, heat-sensitive element 6 detects the temperature and control part 7 acts to reduce or stop outputting of inverter circuit 4. Consequently, overheating of cooking vessel 1 can be stably prevented by using infrared sensor 5 and heat-sensitive element 6 in combination. That is, heat-sensitive element 6 can be efficiently used for temperature control. Such control is especially effective for cooking of deep-fried dish at high temperature without using any dedicated cooking vessel.

Further, after a lapse of predetermined time t1 from the start of heating, control part 7 changes the control temperature value for heat-sensitive element 6 from control temperature value S2 to control temperature value S1 when increase ΔV in the output value detected by infrared sensor 5 is not more than threshold value TH1. At this time, when the detected temperature of heat-sensitive element 6 is not more than control temperature value S1, the temperature of heating coil 3 is controlled according to the output of infrared sensor 5. Even if temperature control of heating coil 3 according to the output of infrared sensor 5 does not work, when the detected temperature of heat-sensitive element 6 exceeds control temperature value S1, control part 7 performs temperature control to prevent overheating.

Accordingly, when infrared sensor 5 does not normally function, for example, the position of cooking vessel 1 is displaced and increase ΔV in the output value is smaller than threshold value TH1, by lowering the control temperature value for heat-sensitive element 6 to control temperature value S1, the temperature of the bottom surface of cooking vessel 1 can be controlled to be low so that the heating operation can be continued more safely. When the user finds the displacement and properly places cooking vessel 1 and thus, increase ΔV in the output value becomes larger than threshold value TH1, the control temperature value may be set to control temperature value S3. Thereby, in the case where the position of cooking vessel 1 is displaced, if the user finds the displacement and properly places cooking vessel 1, temperature control by infrared sensor 5 can be performed without any problem. In addition, the cooking vessel can be heated to target temperature according to control by infrared sensor 5 without turning on the power switch again, realizing the easy-to-use induction heating cooker. Even when increase ΔV in the output value becomes larger than threshold value TH1 after the control temperature value of heat-sensitive element 6 is set to control temperature value S1, the control temperature value need not be changed to control temperature value S2. This is safer.

Further, in this embodiment, assuming that the content of cooking vessel 1 is 2 liters or less, specific control temperature values S1 to S3 and threshold value TH1 are set. However, it is possible to perform setting so as to have the same effect even when the content is increased by changing the threshold value TH1.

Further, in this embodiment, every after passage of predetermined time t2, increase ΔV in the output value of infrared sensor 5 of cooking vessel 1 for predetermined time t3 is calculated and compared with threshold value TH1. However, an average of output values ΔV during multiple predetermined time t3 may be calculated and the average value may be compared with threshold value TH1.

As described above, in this embodiment, in cooking of deep-fried dish, at the start of heating, control part 7 sets the control temperature value for heat-sensitive element 6 to control temperature value S2, and after a lapse of predetermined time t1 from the start of heating, every after passage of predetermined time t2, control part 7 calculates increase ΔV in the output value of infrared sensor 5 for predetermined time t3 that is smaller than predetermined time t1, changes the control temperature value to control temperature value S1 that is smaller than control temperature value S2 when increase ΔV in the output value is smaller than predetermined threshold value TH1, and sets the control temperature value to control temperature value S3 which is higher than control temperature value S1 when increase ΔV in the output value is larger than threshold value TH1.

Generally, the temperature of heat-sensitive element 6 immediately after the start of heating unstably varies depending on material and thickness of cooking vessel 1 or temperature of cooking vessel 1 and top plate 2 at the start of heating. However, in this embodiment, for predetermined time t1 as a time period from the start of heating to the time when increase ΔV in the output value becomes sufficiently larger than threshold value TH1, the control temperature value for heat-sensitive element 6 can be set to relatively high control temperature value S2 that is not affected by temperature variation immediately after the start of heating. When the control temperature value is set to control temperature value S2, overheating of unexpected cooking vessel 1 can be prevented. Further, when the control temperature value is set to control temperature value S1, even if the infrared sensor 5 does not normally work, for example, cooking vessel 1 is displaced from infrared sensor 5 during heating, the temperature of cooking vessel 1 can be maintained at predetermined temperature while preventing overheating. When the user finds that cooking vessel 1 is displaced and restarts the cooker, oil temperature is increased from control temperature value S1 to the target temperature, and therefore, the target temperature can be achieved in a short time, which can improve the usability. Further, when the control temperature value is set to control temperature value S3, as in the case where the control temperature value is set to control temperature value S2, overheating of unexpected cooking vessel 1 can be prevented.

In other words, by switching the control temperature value for the heat-sensitive element, even when it is determined that the cooking vessel is improperly placed, the temperature of the cooking vessel can be maintained low to continue heating while preventing overheating, and time required to achieve the target temperature can be reduced, thereby improving usability for the user.

In this embodiment, when placement position determining part 8 determines that the placement position of cooking vessel 1 is improper, control part 7 may reduce the output of the inverter circuit 4 or stop the heating operation. Thereby, even when cooking vessel 1 is displaced from sensor window 2*a* of infrared sensor 5, safety can be similarly ensured.

As described above, in this embodiment, the placement position of cooking vessel 1 is determined except for during the initial unstable state at the start of heating. Furthermore, cooking vessel 1 storing much oil therein can be distinguished from cooking vessel 1 improperly placed. Therefore, it is possible to accurately detect that cooking vessel 1 is not properly placed on top plate 2. In addition, it is easy for the user to use.

Second Exemplary Embodiment

Figure 4:
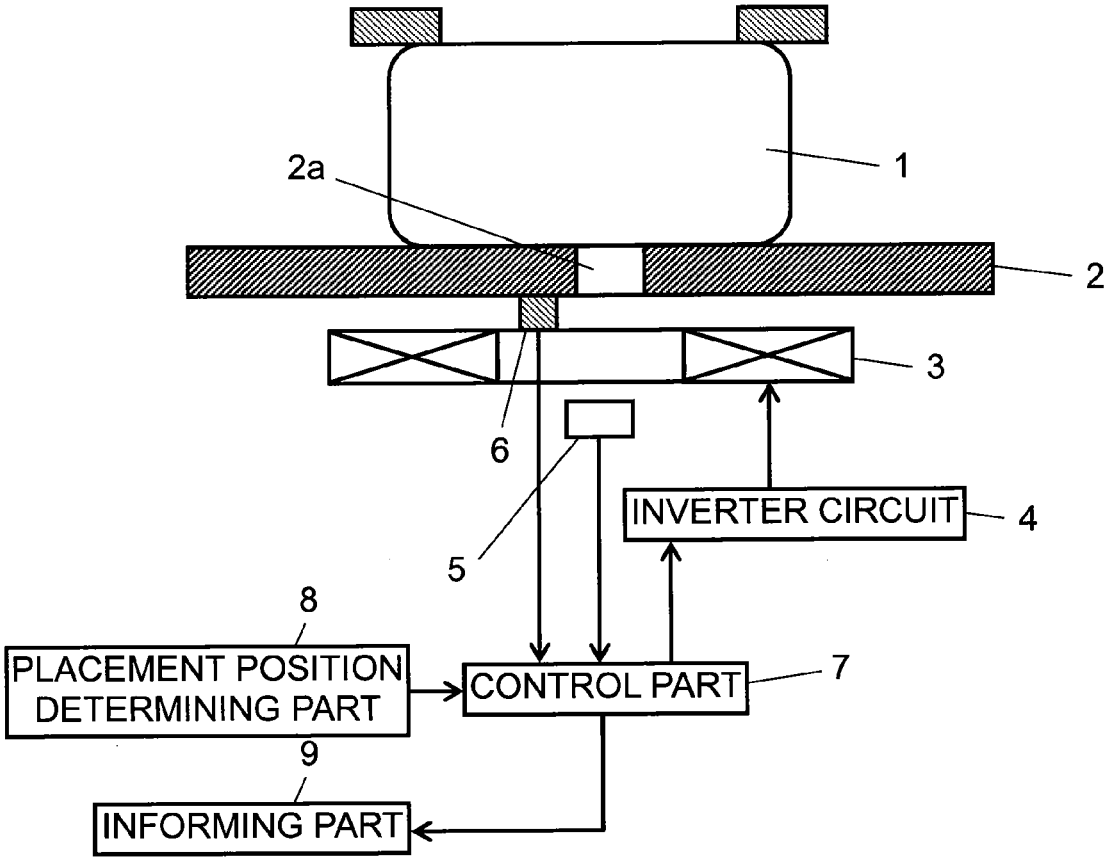
FIG. 4 is a block diagram showing an induction heating cooker according to a second exemplary embodiment of the present invention.

A second exemplary embodiment of the present invention will be described. The same constituents as those in the first exemplary embodiment are given the same reference numerals and description thereof is omitted, and only differences between the second exemplary embodiment and the first exemplary embodiment will be described. FIG. 4 is a block diagram showing an induction heating cooker according to this embodiment.

One difference between this embodiment and the first exemplary embodiment is that, as shown in FIG. 4, informing part 9 for issuing a warning is electrically connected to control part 7. Another difference is that when increase ΔV in infrared sensor output value V for predetermined time t3 becomes threshold value TH1 or less after a lapse of predetermined time t1 from the start of heating, control part 7 determines that the placement position of cooking vessel 1 is improper and informing part 9 informs the fact. Thereby, it is possible to inform whether unexpected cooking vessel 1 is placed or heatable cooking vessel 1 is displaced from sensor window 2*a*.

Informing part 9 may inform that the temperature of cooking vessel 1 reaches control temperature value S1 when the control temperature value is set to control temperature value S1 and the temperature of cooking vessel 1 reaches control temperature value S1 to reduce or stop outputting of inverter circuit 4. Thereby, it is possible to inform whether unexpected cooking vessel 1 is placed or normal cooking vessel 1 is displaced from sensor window 2*a*, resulting in that the heating output is reduced or heating is stopped.

With the above-mentioned configuration, when cooking vessel 1 is not properly placed on top plate 2, control part 7 informs the user that cooking vessel 1 is not properly placed. Thereby, the user can replace cooking vessel 1 at a proper position. For this reason, rapid proper heating can be achieved. In the case where the user replaces cooking vessel 1 at the proper position, when increase ΔV in the output value detected by infrared sensor 5 becomes larger than threshold value TH1, the control temperature value can be changed to the control temperature value that is higher than control temperature value S1, for example, control temperature value S2 or S3. In this case, usability is improved. In the case where the control temperature value S1 is set so as not to be automatically changed even if the user replaces cooking vessel 1 at the proper position, the user stops heating once and restarts heating, thereby setting the control temperature value to control temperature value S2.

As described above, in this embodiment, informing part 9 for issuing the warning is further provided and when it is determined that cooking vessel 1 is not properly placed on top plate 2 after a lapse of predetermined time t1 from the start of heating, control part 7 informs the fact through informing part 9.

Thus, it is possible to accurately detect, for example, the case where cooking vessel 1 is not properly placed on top plate 2 and inform the user that cooking vessel 1 is not properly placed in order to rapidly perform proper heating.

Informing part 9 can obtain a similar effect by using a display device such as LED and LCD other than warning of buzzer sound, voice and the like.

Third Exemplary Embodiment

Figure 5:
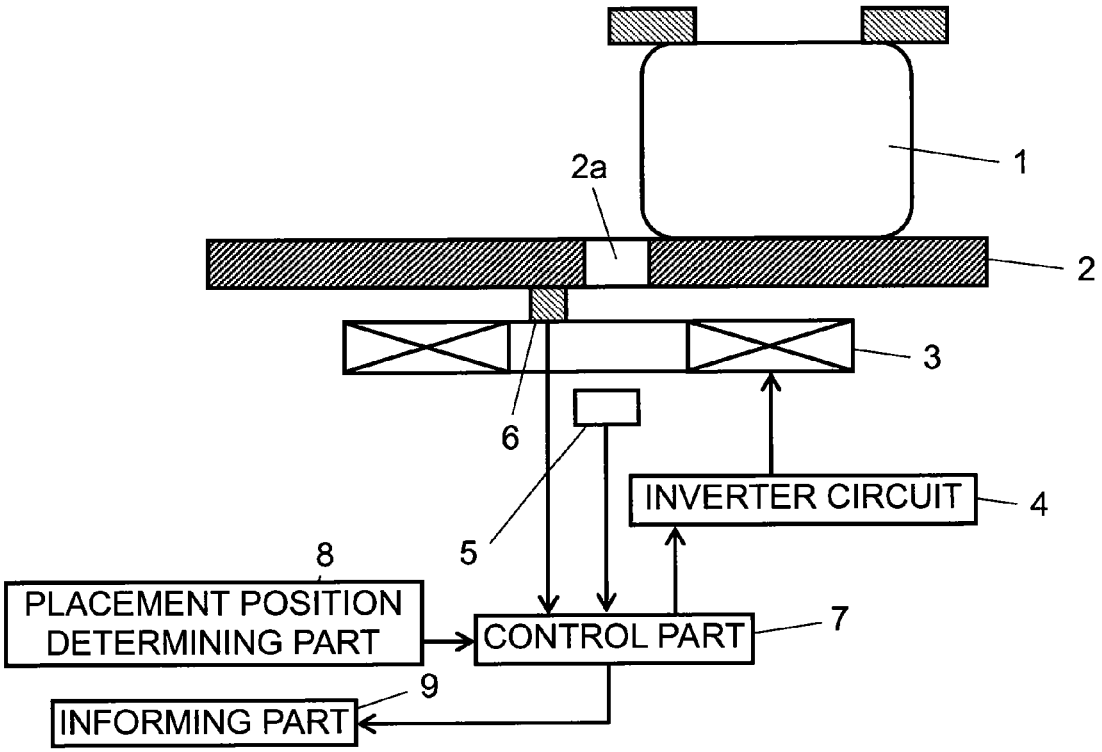
FIG. 5 is a block diagram of an induction heating cooker in the case where a cooking vessel is improperly placed according to a third exemplary embodiment of the present invention.
Figure 6:
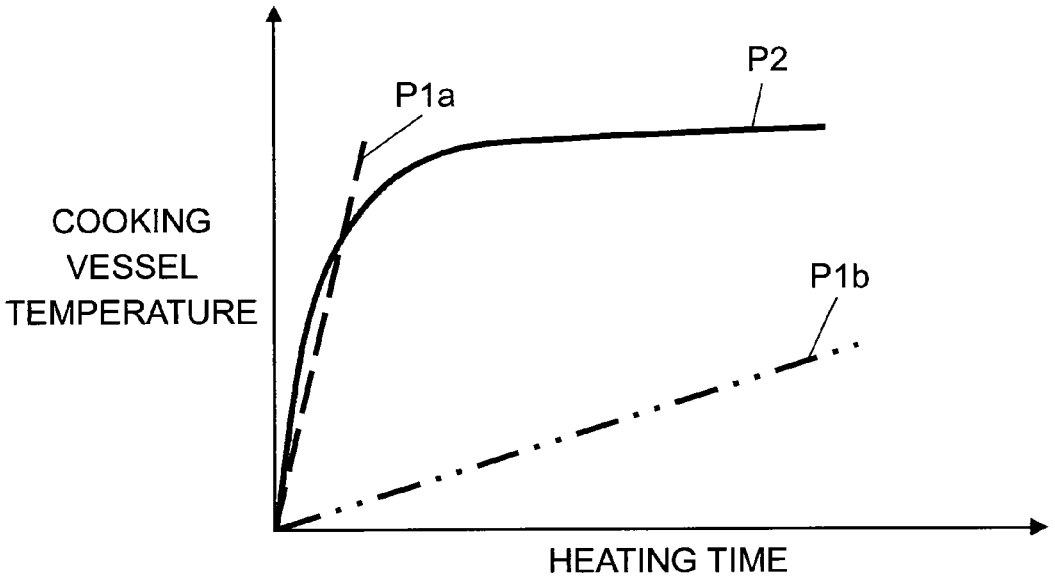
FIG. 6 is a diagram showing a relationship between heating time and temperature of a side surface of the cooking vessel in the case where the cooking vessel is improperly placed and the case where the cooking vessel is properly placed in the third exemplary embodiment.

A third exemplary embodiment of the present invention will be described. FIG. 5 is a block diagram of the induction heating cooker in the case where the cooking vessel is improperly placed in this embodiment. FIG. 6 is a diagram showing a relationship between heating time and temperature of a side surface of the cooking vessel in the case where the cooking vessel is properly placed and the case where the cooking vessel is improperly placed in this embodiment.

Description of the same constituents as those in the first exemplary embodiment is omitted, and only a difference between the third exemplary embodiment and the first exemplary embodiment will be described. The difference between this embodiment and the first exemplary embodiment is that placement position determining part 8 determines that the placement position of cooking vessel 1 is improper only when detected temperature T of infrared sensor 5 is higher than predetermined temperature value T1, in addition to the function of placement position determining part 8 in the first exemplary embodiment shown in FIG. 1. Moreover, in the first exemplary embodiment, the output voltage value corresponding to infrared emissions detected by infrared sensor 5 is used as the output value of infrared sensor 5, and an increase in the output voltage value of infrared sensor 5 is used as the increase in the output value of infrared sensor 5. However, in this embodiment, detected temperature T of infrared sensor 5, which is obtained by converting the output value of infrared sensor 5 into corresponding temperature, and rise value ΔT of the detected temperature value of the infrared sensor 5 are used for the explanation. That is, a vertical axis in FIG. 2 is reread as infrared sensor temperature T and increase ΔV is reread as rise value ΔT.

Basic operations of the induction heating cooker having such a configuration are the same as those in the first exemplary embodiment. When cooking vessel 1 is heated, and after a lapse of predetermined time t1 from the start of heating, infrared sensor 5 receives the infrared ray emitted from cooking vessel 1, control part 7 calculates rise value ΔT of detected temperature T of infrared sensor 5 for predetermined time t3 (hereinafter, also referred to as temperature-rise value ΔT) every after passage of predetermined time t2. According to calculated temperature-rise value ΔT and detected temperature T of infrared sensor 5, control part 7 detects that cooking vessel 1 is improperly placed on top plate 2.

In this embodiment, in the similar way to that in FIG. 2, after a lapse of predetermined time t1 from the start of heating, placement position determining part 8 calculates temperature-rise value ΔT of detected temperature T for predetermined time t3 every after passage of predetermined time t2, and determines that the placement position of cooking vessel 1 is improper when temperature-rise value ΔT is smaller than predetermined threshold value TH1 (for example, 12° C.) for time that is longer than predetermined time t4 (sixth predetermined time), and detected temperature T is larger than predetermined temperature value T1 (for example, 210° C.).

Specifically, in this embodiment, when cooking vessel 1 is properly placed on top plate 2 as shown in FIG. 1, the bottom surface of cooking vessel 1 is located above sensor window 2*a*, and therefore, infrared sensor 5 detects the temperature of the bottom surface of cooking vessel 1. After the start of heating, the temperature of the bottom surface of generally used cooking vessel 1 that stores oil of, for example, 800 g, as represented by broken line P1*a* in FIG. 6, increases substantially linearly with a predetermined gradient.

On the contrary, as shown in FIG. 5, when the bottom surface of cooking vessel 1 is slightly displaced from sensor window 2*a* and is not located above sensor window 2*a*, the side surface of cooking vessel 1 is located in the vicinity of an outer periphery of sensor window 2*a* and heating is started in the state where cooking vessel 1 is improperly placed on top plate 2, infrared sensor 5 detects temperature of the side surface of cooking vessel 1 in the vicinity of sensor window 2*a*. The temperature of the side surface of cooking vessel 1 is, as represented by solid line P2 in FIG. 6, becomes characteristically saturated at a certain point. For this reason, detected temperature T corresponding to infrared emissions detected by infrared sensor 5 is also proportional to the temperature of the side surface of cooking vessel 1. Thus, temperature-rise value ΔT gradually decreases as it gets closer to the saturated state and finally becomes 0 (see below-mentioned solid line P3 in FIG. 8).

When cooking vessel 1 storing a large amount of oil (for example, 3 liters or more) therein is properly placed on top plate 2, as represented by chain double-dashed line P1*b* in FIG. 6, the temperature of the cooking vessel increases with heating time substantially linearly with a predetermined gentle gradient.

In a similar way to that described in the first exemplary embodiment with reference to FIG. 2, every after passage of predetermined time t2 (for example, 1 second), temperature-rise value ΔT of detected temperature T of infrared sensor 5 for predetermined time t3 (for example, 1 minute) is calculated. As apparent from FIG. 6, since temperature-rise value ΔT of detected temperature T is small in both of the case where the amount of oil is small and the case where cooking vessel 1 is not properly placed on top plate 2, it is hard to distinguish the two cases from each other. However, there is a difference between the cases in detected temperature T.

Then, in this embodiment, when temperature-rise value ΔT of infrared sensor 5 is smaller than threshold value TH1 for a time that is longer than predetermined time t4 (for example, 5 seconds), that is, a calculation result of temperature-rise value ΔT of infrared sensor 5 is smaller than threshold value TH1 consecutively a predetermined number of times or more (for example, five times or more), and detected temperature T of infrared sensor 5 is higher than predetermined temperature value T1 (for example, 210° C.), placement position determining part 8 determines that placement position of cooking vessel 1 is improper. Thereby, the bottom surface of cooking vessel 1 is slightly displaced from sensor window 2*a* and is not located above sensor window 2*a* and the side surface of cooking vessel 1 is located in the vicinity of the outer periphery of sensor window 2*a* as shown in FIG. 5, placement position determining part 8 can detect that cooking vessel 1 is not properly placed on top plate 2, which is distinguished from the case where the amount of oil stored in cooking vessel 1 located at the proper placement position is large (for example, 3 liters or more). Predetermined temperature value T1 may be set to be slightly higher than temperature that is generally used in cooking of deep-fried dish and not cause overheating.

As described above, when detected temperature T is not more than predetermined temperature value T1, placement position determining part 8 does not determine that placement position of cooking vessel 1 is improper, and therefore, even when the amount of oil stored in cooking vessel 1 located at the proper placement position of is large, it is possible to prevent wrong determination that the placement position of cooking vessel 1 is improper.

When placement position determining part 8 determines that placement position of cooking vessel 1 is improper, as in the first exemplary embodiment, the control temperature value for heat-sensitive element 6 is set to control temperature value S1 that is lower than control temperature value S2. For this reason, heating can be continued while preventing overheating of cooking vessel 1, thereby improving usability for the user.

When placement position determining part 8 determines that placement position of cooking vessel 1 is improper, as described above instead that the control temperature value for heat-sensitive element 6 is set to control temperature value S1 that is lower than control temperature value S2, heating may be stopped or heating outputting may be reduced.

This embodiment is especially effective in adjusting the temperature of oil in cooking of deep-fried dish, which requires highly accurate temperature adjustment.

As described above, in this embodiment, after a lapse of predetermined time t1 from the start of heating, control part 7 calculates temperature-rise value ΔT of infrared sensor 5 for predetermined time t3 every after passage of predetermined time t2 and placement position determining part 8 determines that placement position of cooking vessel 1 is improper when temperature-rise value ΔT is smaller than predetermined time t4 or predetermined threshold value TH1 for a time that is longer than predetermined time t4 and detected temperature T of infrared sensor 5 is larger than predetermined temperature value T1.

Thereby, even when the amount of oil is large and the temperature-rise gradient of the temperature of the bottom of the pan is small, placement position determining part 8 does not wrongly determine that cooking vessel 1 is not properly placed on top plate 2. When the bottom surface of cooking vessel 1 is displaced from sensor window 2*a* and is not located above sensor window 2*a*, and the side surface of cooking vessel 1 is located in the vicinity of the outer periphery of sensor window 2*a*, placement position determining part 8 can accurately detect that cooking vessel 1 is not properly placed on top plate 2.

Further, when it is determined that the placement position of cooking vessel 1 is improper, control part 7 changes the control temperature value of heat-sensitive element 6 from control temperature value S2 to control temperature value S1 that is lower than control temperature value S2.

Thereby, even when it is determined that cooking vessel 1 is improperly placed, heating can be continued while preventing overheating, and the cooker can be rapidly restarted when heating is started again, improving usability for the user.

Fourth Exemplary Embodiment

Figure 7:
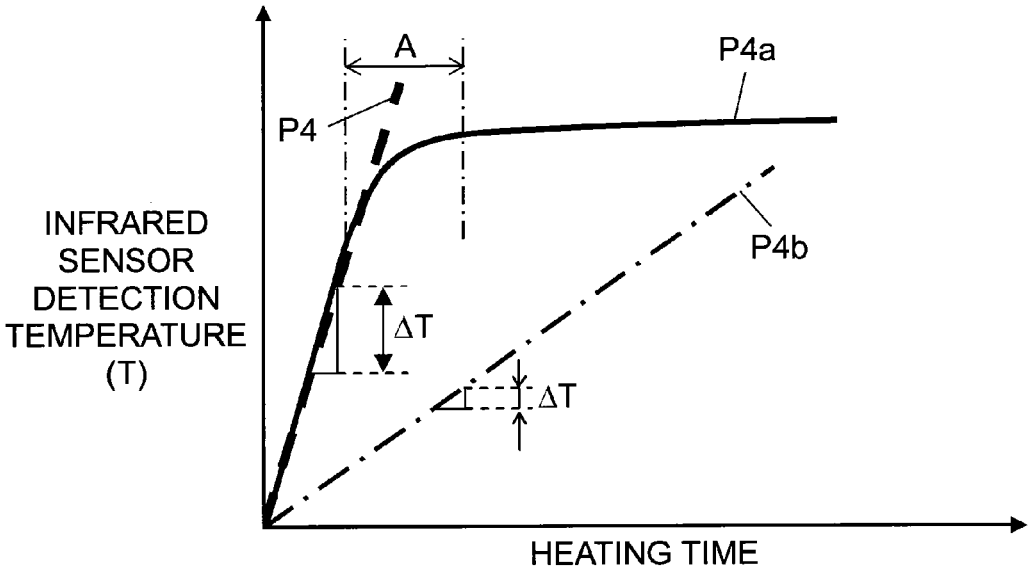
FIG. 7 is a diagram showing a relationship between heating time and infrared sensor detection temperature in the case where the cooking vessel is improperly placed and the case where the cooking vessel is properly placed in a fourth exemplary embodiment of the present invention.
Figure 8:
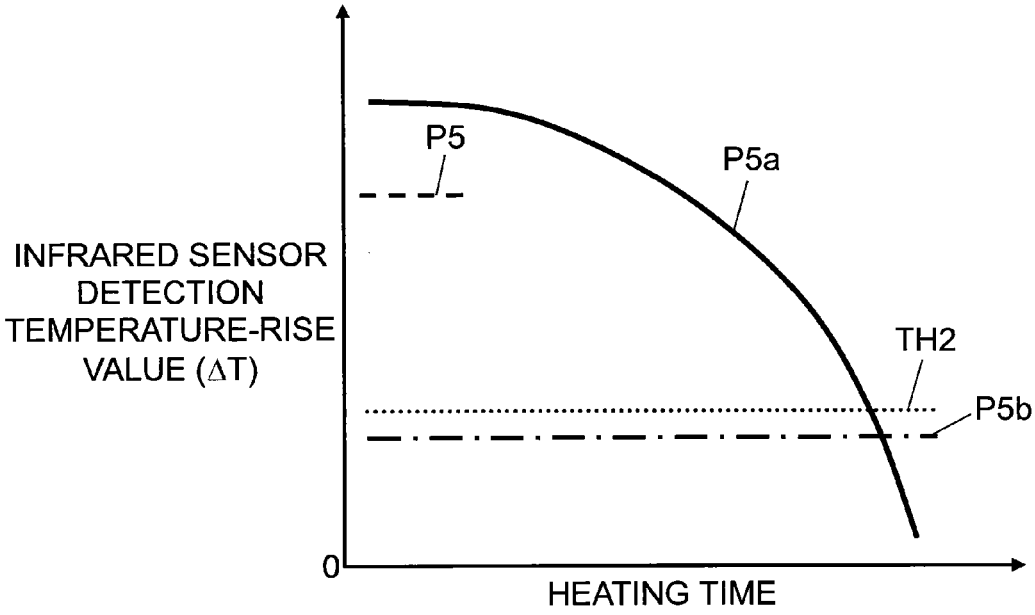
FIG. 8 is a diagram showing a relationship between heating time and an increase in the infrared sensor detection temperature in the case where the cooking vessel is improperly placed in the fourth exemplary embodiment of the present invention.
Figure 9:
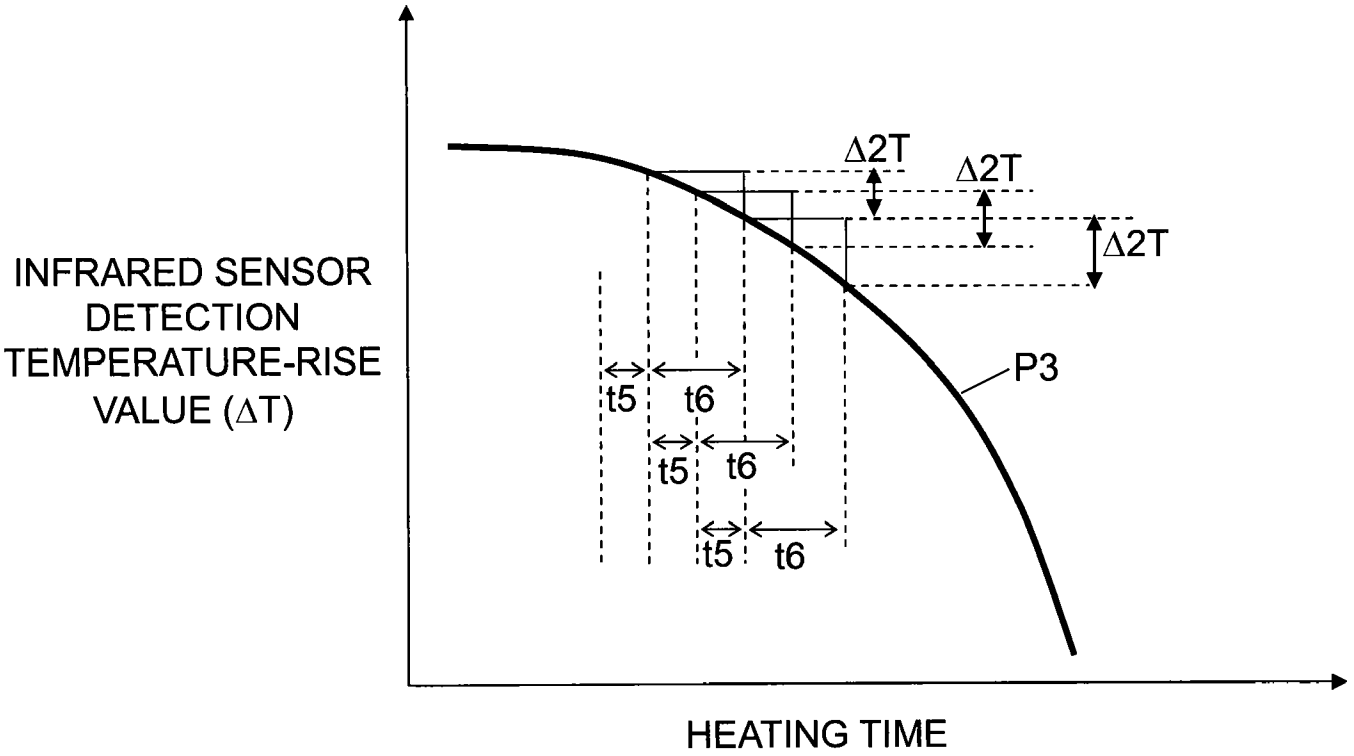
FIG. 9 is a diagram for describing a relationship between the infrared sensor detection temperature-rise value and heating time in the case where the cooking vessel is improperly placed in the fourth exemplary embodiment.
Figure 10:
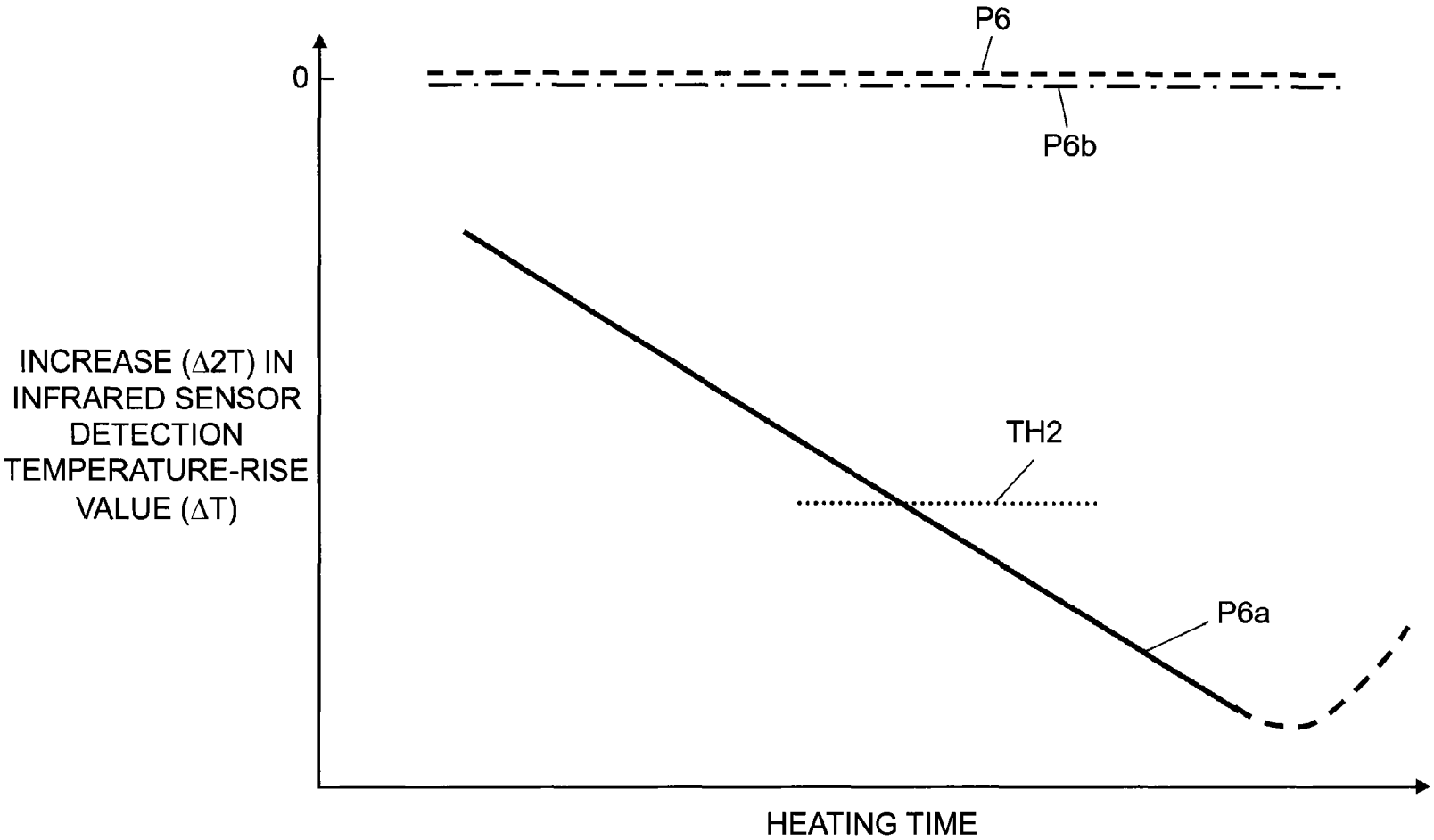
FIG. 10 is a diagram for describing a relationship between an increase in the infrared sensor detection temperature-rise value and heating time in the case where the cooking vessel is improperly placed and the case where cooking vessel is properly placed in the fourth exemplary embodiment.

An induction heating cooker according to a fourth exemplary embodiment of the present invention will be described. FIG. 7 is a diagram showing a relationship between temperature value detected by infrared sensor 5 (hereinafter, also referred to as merely the detected temperature) and heating time in this embodiment. FIG. 8 and FIG. 9 are enlarged diagram showing a change in temperature gradient in the vicinity of a bending point of line P4*a* (scope represented by A) in FIG. 7. FIG. 8 and FIG. 9 are diagrams each showing a relationship between temperature-rise value ΔT of the detected temperature of the infrared sensor for predetermined time t3 (hereinafter, also referred to as merely the temperature-rise value ΔT) and heating time in this embodiment. FIG. 10 is a diagram showing a relationship between increase Δ2T in temperature-rise value ΔT of the detected temperature of the infrared sensor for predetermined time t6 (fifth predetermined time) and heating time in this embodiment. The same constituents as those in the third exemplary embodiment are given the same reference numerals and description thereof is omitted, and only a difference between the fourth exemplary embodiment and the third exemplary embodiment will be described.

The difference between this embodiment and the third exemplary embodiment is that, after a lapse of predetermined time t1 from the start of heating, placement position determining part 8 first calculates temperature-rise value ΔT of infrared sensor 5 for predetermined time t3 every after passage of predetermined time t2, and calculates increase Δ2T in temperature-rise value ΔT of infrared sensor 5 for predetermined time t6 every after passage of predetermined time t5. Then, placement position determining part 8 determines that placement position of cooking vessel 1 is improper when temperature-rise value ΔT of infrared sensor 5 is less than threshold value TH1 for predetermined time t4 or longer, detected temperature T of infrared sensor 5 is larger than predetermined temperature value T1, and a calculated value of increase Δ2T in temperature-rise value ΔT of infrared sensor 5 is less than threshold value TH2 as a negative value (second threshold value, TH2<0) for predetermined time t7 (ninth predetermined time) or longer.

Operations and effects of the induction heating cooker thus configured will be specifically described below. In FIG. 7, as in FIG. 1, line P4 shows the case where cooking vessel 1 storing a standard amount of oil (for example, 800 g. the same hereinafter) therein is properly placed on top plate 2.

In this case, as the heating time increases, the detected temperature of the infrared sensor, which corresponds to the output value of infrared sensor 5, also increases. That is, detected temperature T increases with a substantially constant gradient. Line P4*a*, as in FIG. 5, shows the case where cooking vessel 1 is improperly placed on top plate 2. In this case, as described in the third exemplary embodiment, the detected temperature of the side surface of the cooking vessel 1 increases with passage of the heating time and becomes saturated at a predetermined saturation temperature. Accordingly, temperature-rise value ΔT of infrared sensor 5 decreases as the heating time increases. Line P4*b* shows the case where the content in cooking vessel 1 is large (for example, 3 liters). That is, in the case where a large amount of oil is stored in cooking vessel 1, even when cooking vessel 1 is properly placed, it takes time to increase the temperature. For this reason, also when the content in cooking vessel 1 is large, the temperature value of infrared sensor 5 increases with passage of time with a substantially constant gradient that is smaller than the gradient in line P4.

FIG. 8 is a diagram showing a relationship between temperature-rise value ΔT of infrared sensor 5 and heating time in the case where cooking vessel 1 storing a standard amount of oil therein is properly placed, the case where cooking vessel 1 is improperly placed, and the case where cooking vessel 1 storing a large amount of oil therein is properly placed. In FIG. 8, line P5 shows the case where cooking vessel 1 storing a standard amount of oil therein is properly placed. In this case, as apparent from line P4 in FIG. 7, temperature-rise value ΔT of infrared sensor 5 is larger as compared to the case where the cooking vessel 1 storing a large amount of oil therein is properly placed, and is substantially constant. Line P5*a* shows the case where cooking vessel 1 is improperly placed. In this case, as apparent from line P4*a*, especially a section represented by A, in FIG. 7, temperature-rise value ΔT of infrared sensor 5 rapidly decreases from a certain point and becomes saturated. Line P5*b* shows the case where a large amount of oil is stored in cooking vessel 1. In this case, as apparent from line P4*b* in FIG. 7, temperature-rise value ΔT of infrared sensor 5 is smaller than that of line P4 and is substantially constant.

That is, when cooking vessel 1 is properly placed and the content stored in cooking vessel 1 is large, temperature-rise value ΔT of infrared sensor 5 is small. For this reason, it is difficult to distinguish this case from the case where cooking vessel 1 is improperly placed merely by detecting temperature-rise value ΔT of infrared sensor 5. For example, when temperature-rise value ΔT of infrared sensor 5 in the case where the content is large is close to temperature-rise value ΔT in the saturated state of infrared sensor 5 in the case where cooking vessel 1 is improperly placed, temperature-rise value ΔT of infrared sensor 5 is less than threshold value TH1 for predetermined time t4 and therefore, it is difficult to distinguish both from each other.

As described above, even when the amount of oil stored in cooking vessel 1 is large, temperature-rise value ΔT of infrared sensor 5 is small and therefore, it is difficult to distinguish this case from the case where cooking vessel 1 is improperly placed. For this reason, in this embodiment, first, as shown in FIG. 9, there is calculated increase Δ2T in temperature-rise value ΔT of infrared sensor 5 for predetermined time t6 (for example, 30 seconds) every after passage of predetermined time t5 (for example, 1 second).

FIG. 10 is a diagram showing a relationship between increase Δ2T in temperature-rise value ΔT of infrared sensor 5 and heating time in the case where cooking vessel 1 storing a standard amount of oil is properly placed, cooking vessel 1 is improperly placed, and the case where cooking vessel 1 storing a large amount of oil therein is properly placed. In FIG. 10, line P6 shows the case where cooking vessel 1 storing a standard amount of oil therein is properly placed. In this case, as apparent from line P5 in FIG. 8, increase Δ2T in temperature-rise value ΔT of infrared sensor 5 is about 0 and constant. Line P6*a* shows the case where cooking vessel 1 is improperly placed. In this case, as apparent from line P5*a* in FIG. 8, temperature-rise value ΔT of infrared sensor 5 gradually decreases, while increase Δ2T in temperature-rise value ΔT of infrared sensor 5 is negative and its absolute value gradually increases, then, becomes smaller again and converges to 0. Line P6*b* shows the case where the content in cooking vessel 1 is large. In this case, as apparent from line P5*b* in FIG. 8, like line P6*b*, increase Δ2T in temperature-rise value ΔT of infrared sensor 5 is about 0 and constant.

In FIG. 9 and FIG. 10, in the case where cooking vessel 1 is improperly placed on top plate 2, increase Δ2T in temperature-rise value ΔT becomes a negative value as it gets close to saturation temperature (see FIG. 7), and when the value is less than threshold value TH2 (TH2<0) for predetermined time t7 (for example, 3 seconds) or longer, that is, the calculation value of increase Δ2T in temperature-rise value ΔT of infrared sensor 5 is less than threshold value TH2 consecutively predetermined number of times or more (for example, five times or more), placement position determining part 8 determines that placement position of cooking vessel 1 is improper.

When placement position determining part 8 determines that placement position of cooking vessel 1 is improper, control part 7 sets the control temperature value for heat-sensitive element 6 to control temperature value S1 that is lower than control temperature value S2. That is, when increase Δ2T in temperature-rise value ΔT, which is a negative value having a large absolute value less than negative threshold value TH2, continues for some time, this case can be distinguished from the case where increase Δ2T in temperature-rise value ΔT that hardly changes and cooking vessel 1 storing a large amount of oil therein is located at a proper position. Thereby, as compared to configuration in the third exemplary embodiment, configuration in this embodiment can distinguish the case where cooking vessel 1 is improperly placed from the case where cooking vessel 1 having large content is improperly placed with higher accuracy. Consequently, since heating can be achieved without wrongly determining even the case where the content in cooking vessel 1 is large as the case where cooking vessel 1 is improperly placed, usability for the user can be improved.

With the configuration described in this embodiment, when detected temperature T of infrared sensor 5 is not less than predetermined temperature value T1 and temperature-rise value ΔT or increase Δ2T in temperature-rise value ΔT satisfies both requirements for threshold value TH1 and threshold value TH2, it is determined that cooking vessel 1 is improperly placed. However, even when increase 42T in temperature-rise value ΔT detected by infrared sensor 5 is calculated, and irrespective of the requirement for threshold value TH1, based on whether or not the detected temperature of infrared sensor 5 is not less than predetermined temperature value T1 and satisfies the requirement for threshold value TH2, placement position determining part 8 can determine whether the placement position of cooking vessel 1 is improper or proper, and similar effect can be achieved.

As described above, in this embodiment, after a lapse of predetermined time t1 from the start of heating, control part 7 calculates temperature-rise ΔT of infrared sensor 5 for predetermined time t3 every after passage of predetermined time t2, and calculates increase Δ2T in temperature-rise value ΔT of infrared sensor 5 for predetermined time t6 every after passage of predetermined time t5 when temperature-rise ΔT of infrared sensor 5 is smaller than threshold value TH1 for a time that is longer than predetermined time t4 and detected temperature T of infrared sensor 5 is larger than predetermined temperature value T1, and placement position determining part 8 determines that placement position of cooking vessel 1 is improper when an absolute value of increase Δ2T in temperature-rise value ΔT is smaller than threshold value TH2 for a time that is longer than predetermined time t7. When placement position determining part 8 determines that placement position of cooking vessel 1 is improper, control part 7 lowers the control temperature value for heat-sensitive element 6 from control temperature value S2 to control temperature value S1.

Thereby, since heating can be achieved without wrongly determining the case where the content in cooking vessel 1 is large as the case where cooking vessel 1 is improperly placed, usability for the user can be improved.

Fifth Exemplary Embodiment

A fifth exemplary embodiment of the present invention will be described. The same constituents as those in the third exemplary embodiment are given the same reference numerals and description thereof is omitted, and only a difference between the fifth exemplary embodiment and the third exemplary embodiment will be described. The difference between this embodiment and the third exemplary embodiment is that placement position determining part 8 measures temperature-rise value ΔTS from detected temperature T of infrared sensor 5 at the start of heating, and when the state where temperature-rise value ΔTS is larger than predetermined value DT (first predetermined value) continues for predetermined time t8 (seventh predetermined time) or longer, even before a lapse of predetermined time t1 from the start of heating, starts determination of the placement position of cooking vessel 1.

Operations and effects of the induction heating cooker thus configured will be specifically described below. Since the output of infrared sensor 5 is not stable immediately after the start of heating due external disturbance and the like, temperature-rise value ΔT of infrared sensor 5 cannot be properly calculated after the start of heating. Accordingly, in the first to fourth exemplary embodiments, after a lapse of predetermined time t1 from the start of heating, placement position determining part 8 performs the placement position determining operation.

However, although this embodiment has the configuration described in the first to fourth exemplary embodiments, following operations are performed. When the state where temperature-rise value ΔTS from detected temperature T of infrared sensor 5 in the initial stage at the start of heating is larger than predetermined value DT (for example, 20° C.) continues for predetermined time t8 (for example, 5 seconds) or longer, even before a lapse of predetermined time t1 from the start of heating, as described in the first, third and fourth exemplary embodiments, placement position determining part 8 determines the placement position of cooking vessel 1 on top plate 2. For this reason, it is possible to reduce the affect of external disturbance and the like in the initial stage at the start of heating, determine the placement position of cooking vessel 1 on top plate 2 more rapidly, cut time for cooking vessel 1 to be heated at an improper position and reduce the possibility that the placement position of cooking vessel 1 is wrongly determined.

As described above, in this embodiment, placement position determining part 8 determines placement position of cooking vessel 1 when the state where temperature-rise value ΔTS from detected temperature T of infrared sensor 5 at the start of heating is larger than predetermined value DT continues for predetermined time t8 or longer.

Thereby, it is possible to eliminate instability factors in the heating initial stage, reduce the possibility that the placement position of cooking vessel 1 is wrongly determined, and cut the time for cooking vessel 1 to be heated at an improper position.

In this embodiment, placement position determining part 8 performs the placement position determining operation when temperature-rise value ΔTS from the detected temperature of the infrared sensor 5 at the start of heating is larger than predetermined value DT before a lapse of predetermined time t1 from the start of heating. However, instead of this configuration, placement position determining part 8 may perform the placement position determining operation when increase in the output voltage of infrared sensor 5 from the start of heating is larger than predetermined value DV (second predetermined value, for example, output voltage corresponding to 20° C.) before a lapse of predetermined time t1 from the start of heating. This configuration also achieves similar effects. Also in this case, placement position determining part 8 may perform the placement position determining operation when the state where the increase in the output voltage of infrared sensor 5 from the start of heating is larger than predetermined value DV continues for predetermined time t9 (eighth predetermined time) or longer.

Although a thermistor is used as heat-sensitive element 6 in each of the above-mentioned exemplary embodiments, heat-sensitive element 6 is not limited to the thermistor as long as it can achieve similar effects.

Although placement position determining part 8 calculates the rising gradient of detected temperature T of infrared sensor 5 by calculating increase value Δ of the detected temperature of infrared sensor 5 for predetermined time t3 that is smaller than predetermined time t1 in each of the above-mentioned exemplary embodiments, a method of calculating the rising gradient of the detected temperature of infrared sensor 5 is not limited to this. For example, the rising gradient of detected temperature T of infrared sensor 5 with passage of time may be calculated by measuring time for detected temperature T of infrared sensor to reach a predetermined rise value.

In the fourth exemplary embodiment, although placement position determining part 8 calculates increase gradient Δ2T of rising gradient ΔT of detected temperature T of infrared sensor 5 with passage of time by calculating increase in the rising gradient for predetermined time t6, a method of calculating increase gradient Δ2T of rising gradient ΔT of the detected temperature of infrared sensor 5 is not limited to this. Since increase gradient Δ2T of rising gradient ΔT of the detected temperature of infrared sensor 5 with passage of time corresponds to a second derivative value of the detected temperature of infrared sensor 5 with respect to time, any method corresponding to this may be employed. For example, increase gradient Δ2T of rising gradient ΔT of detected temperature of infrared sensor 5 with passage of time may be calculated by measuring time for the rising gradient of detected temperature T of infrared sensor 5 to reach a predetermined increase.

Configuration of each of the exemplary embodiments may be implemented in combination as appropriate.

As has been described, the present invention includes the top plate for carrying the cooking vessel placed thereon, the heating coil provided under the top plate and for inductively heating the cooking vessel, the inverter circuit for supplying the high-frequency current to the heating coil, the infrared sensor for detecting the infrared ray emitted from the bottom surface of the cooking vessel, the control part for reducing the output of the inverter circuit or stopping the heating operation when the detected temperature of the infrared sensor is higher than the control temperature value for the infrared sensor, and the placement position determining part for performing the placement position determining operation of calculating the rising gradient of the output value of the infrared sensor every after passage of a first predetermined time and performing the placement position determining operation for determining that the placement position of the cooking vessel is improper when the rising gradient is smaller than the first threshold value, and the placement position determining part performs the placement position determining operation after a lapse of the second predetermined time from the start of heating.

With such a configuration, the temperature of the cooking vessel can be controlled by use of the infrared sensor with high response, and wrong detection of the infrared sensor can be prevented. Further, even if the cooking vessel is displaced from the infrared sensor during heating, any slight displacement can be determined accurately to prevent overheating of the cooking vessel, which is excellent in usability.

INDUSTRIAL APPLICABILITY

Even when the cooking vessel is improperly placed, since the induction heating cooker according to the present invention can properly heat the cooking vessel by use of the infrared sensor while preventing overheating of the cooking vessel, the induction heating cooker is useful as household or commercial induction heating cookers for inductively heating the cooking vessel and performing temperature control.

REFERENCE MARKS IN THE DRAWINGS

1 cooking vessel
2 top plate
2 sensor window
3 heating coil
4 inverter circuit
5 infrared sensor
6 heat-sensitive element
7 control part
8 placement position determining part
9 informing part

The invention claimed is:

1. An induction heating cooker comprising:

a top plate configured to carry a cooking vessel placed thereon;

a heating coil provided under the top plate and configured to inductively heat the cooking vessel;

an inverter circuit configured to supply a high-frequency current to the heating coil;

an infrared sensor configured to detect an infrared ray emitted from a bottom surface of the cooking vessel;

a heat-sensitive element in contact with a lower surface of the top plate for detecting a temperature of the cooking vessel;

a control part configured to compare a temperature detected by the heat-sensitive element to a control temperature value associated with the heat-sensitive element, which is set to a first temperature value, and to reduce an output of the inverter circuit or stop a heating operation when the temperature detected by the heat-sensitive element exceeds the control temperature value; and a placement position determining part configured to:

repeatedly determine a temperature detected by the infrared sensor at a period equal to a first predetermined time to thereby periodically determine a rate of increase of an output value of the infrared sensor, when after passage of a second predetermined time from the start of heating, the temperature detected by the infrared sensor is a) determined to be higher than a predetermined temperature value and b) the rate of increase of the output value of the infrared sensor is smaller than a first threshold value, determine that a placement position of the cooking vessel is improper, wherein when the placement position determining part determines that the cooking vessel is improperly placed, the control part is further configured to set the control temperature value associated with the heat-sensitive element to a second temperature value lower than the first temperature value to thereby cause the heating operation to continue up until the second temperature value is detected by the heat-sensitive element and then stop.

2. The induction heating cooker according to claim 1, wherein the placement position determining part is configured to determine that the placement position of the cooking vessel is improper when the rate of increase is less than the first threshold value and when a rise value of detected temperature of the infrared sensor from the start of heating becomes larger than the first predetermined value before a lapse of the second predetermined time from the start of heating.

3. The induction heating cooker according to claim 1, wherein the placement position determining part is configured to determine that the placement position of the cooking vessel is improper when the rate of increase is less than the first threshold value and when an increase in an output voltage of the infrared sensor from the start of heating becomes larger than a second predetermined value before a lapse of the second predetermined time from the start of heating.

4. The induction heating cooker according to claim 1, wherein the placement position determining part is configured to calculate a rate of increase of detected temperature of the infrared sensor by calculating a rise value of the detected temperature of the infrared sensor at a third predetermined time shorter than the second predetermined time.

5. The induction heating cooker according to claim 1, wherein when the placement position part calculates a rate of increase greater than or equal to the predetermined temperature value, the control temperature value is set to a third temperature value that is higher than the first temperature value to thereby cause the heating operation to continue up until the third temperature value is detected by the heat-sensitive element and then stop.

6. The induction heating cooker according to claim 1, wherein the control part is configured to reduce the output of the inverter circuit or stop the heating operation when the placement position determining part determines that the placement position of the cooking vessel is improper.

7. The induction heating cooker according to claim 1, wherein the placement position determining part is configured to calculate an increase gradient of the rate of increase every after passage of a fourth predetermined time and determines that the placement position of the cooking vessel is improper only when the increase gradient is smaller than a second threshold of negative value.

8. The induction heating cooker according to claim 7, wherein the placement position determining part is configured to calculate a value of increase in the rate of increase at a fifth predetermined time every after passage of the fourth predetermined time.

9. The induction heating cooker according to claim 1, wherein the placement position determining part is configured to determine that the placement position of the cooking vessel is improper only when the rate of increase continues to remain smaller than the first threshold value for a time period longer than a sixth predetermined time.

10. The induction heating cooker according to claim 2, wherein the placement position determining part is configured to determine that the placement position of the cooking vessel is improper when the rate of increase is less than the first threshold value and when the rise value of the detected temperature of the infrared sensor from the start of heating continues to be larger than the first predetermined value for a time period longer than a seventh predetermined time.

11. The induction heating cooker according to claim 3, wherein the placement position determining part is configured to determine that the placement position of the cooking vessel is improper when the rate of increase is less than the first threshold value and when the increase in the output voltage of the infrared sensor from the start of heating continues to be larger than the second predetermined value for a time period longer than an eighth predetermined time.

12. The induction heating cooker according to claim 7, wherein the placement position determining part is configured to determine that the placement position of the cooking vessel is improper only when the increase gradient of the rate of increase continues to remain smaller than the second threshold value for a time period longer than a ninth predetermined time.

13. The induction heating cooker according to claim 1, further comprising an informing part for issuing a warning, wherein the control part causes the informing part to issue the warning when the placement position determining part determines that the placement position of the cooking vessel is improper.

14. An induction heating cooker comprising:

a top plate configured to carry a cooking vessel placed thereon;

a heating coil provided under the top plate and configured to inductively heat the cooking vessel;

an inverter circuit configured to supply a high-frequency current to the heating coil;

an infrared sensor configured to detect an infrared ray emitted from a bottom surface of the cooking vessel;

a heat-sensitive element in contact with a lower surface of the top plate for detecting a temperature of the cooking vessel;

a control part configured to compare a temperature detected by the heat-sensitive element to a control temperature value associated with the heat-sensitive element that is set to a first temperature value and to reduce an output of the inverter circuit or stop a heating operation when the temperature detected by the heat-sensitive element exceeds the control temperature value; and a placement position determining part configured to periodically calculate a rate of change of an output value of the infrared sensor, wherein when, during a first time interval, the calculated rate of change exceeds a predetermined temperature value, the control temperature value associated with the heat-sensitive element is set to a second temperature value higher than the first temperature value to thereby cause the heating operation to continue up until the second temperature value is detected by the heat-sensitive element and then stop or reduce.

15. The induction heating cooker according to claim 14, wherein if, during the first time interval, the calculated rate of change is below the predetermined temperature value, the control temperature value is set to a third temperature value lower than the first temperature value to thereby cause the heating operation to continue up until the third temperature value is detected by the heat-sensitive element and then stop or reduce.

16. A method of operating an induction heating cooker comprising:

providing:

a top plate configured to carry a cooking vessel placed thereon;

a heating coil provided under the top plate and configured to inductively heat the cooking vessel;

an inverter circuit configured to supply a high-frequency current to the heating coil;

an infrared sensor configured to detect an infrared ray emitted from a bottom surface of the cooking vessel;

a heat-sensitive element in contact with a lower surface of the top plate for detecting a temperature of the cooking vessel;

a control part configured to compare a temperature detected by the heat-sensitive element to a control temperature value associated with the heat-sensitive element and to reduce an output of the inverter circuit or stop a heating operation when the temperature detected by the heat-sensitive element exceeds the control temperature value; and a placement position determining part configured to repeatedly determine a temperature detected by the infrared sensor at a period equal to a first predetermined time to thereby periodically determine a rate of increase of an output value of the infrared sensor;

setting, by the control part, the control temperature value associated with the heat-sensitive element to a first temperature value;

determining, by placement position determining part, that a placement position of the cooking vessel is improper when a) the rate of increase of the output value of the infrared sensor is smaller than a first threshold value, and b) the temperature detected by the infrared sensor is determined to be higher than a predetermined temperature value after passage of a second predetermined time from the start of heating; and when the placement position determining part determines that the cooking vessel is improperly placed, setting, by the control part, the control temperature value associated with the heat-sensitive element to a second temperature value lower than the first temperature value to thereby cause the heating operation to continue up until the second temperature value is detected by the heat-sensitive element and then stop.

17. The method according to claim 16, wherein if, during the first time interval, the calculated rate of increase is below the predetermined temperature value, the method further comprises setting, by the control part, the control temperature value to a third temperature value lower than the first temperature value to thereby cause the heating operation to continue up until the third temperature value is detected by the heat-sensitive element and then stop or reduce.

* * * * *